US012553335B2

(12) United States Patent
Duncan

(10) Patent No.: US 12,553,335 B2
(45) Date of Patent: Feb. 17, 2026

(54) SYSTEM AND METHOD FOR MONITORING WELL OPERATIONS

(71) Applicant: Intelligent Wellhead Systems Inc., Calgary (CA)

(72) Inventor: Robert Duncan, Calgary (CA)

(73) Assignee: Intelligent Wellhead Systems Inc., Calgary (CA)

( * ) Notice: Subject to any disclaimer, the term of this patent is extended or adjusted under 35 U.S.C. 154(b) by 397 days.

(21) Appl. No.: 18/030,743

(22) PCT Filed: Oct. 6, 2021

(86) PCT No.: PCT/CA2021/051409

§ 371 (c)(1),
(2) Date: Apr. 6, 2023

(87) PCT Pub. No.: WO2022/073125

PCT Pub. Date: Apr. 14, 2022

(65) Prior Publication Data

US 2023/0383644 A1 Nov. 30, 2023

Related U.S. Application Data

(60) Provisional application No. 63/088,350, filed on Oct. 6, 2020.

(51) Int. Cl.

| | |
|---|---|
| ***E21B 47/09*** | (2012.01) |
| ***E21B 43/1185*** | (2006.01) |
| ***E21B 47/12*** | (2012.01) |

(52) U.S. Cl.

CPC ..... *E21B 47/09* (2013.01); *E21B 43/11857* (2013.01); *E21B 47/12* (2013.01)

(58) Field of Classification Search

CPC ..... E21B 47/09; E21B 43/11857; E21B 47/12

See application file for complete search history.

(56) References Cited

U.S. PATENT DOCUMENTS

| | | | | |
|---|---|---|---|---|
| 4,718,048 | A | 1/1988 | Staron et al. | |
| 5,511,038 | A | 4/1996 | Angeleri et al. | |
| 2013/0255939 | A1* | 10/2013 | Kumaran | E21B 47/092 166/53 |
| 2014/0131035 | A1* | 5/2014 | Entchev | E21B 43/119 166/53 |
| 2014/0246238 | A1 | 9/2014 | Abbassian et al. | |

(Continued)

FOREIGN PATENT DOCUMENTS

WO 2013102252 A1 7/2013

OTHER PUBLICATIONS

International Search Report issued in Application No. PCT/CA2021/051409, mailed on Oct. 6, 2021 (6 pages).

(Continued)

*Primary Examiner* — Ricky Go

(74) *Attorney, Agent, or Firm* — Osha Bergman Watanabe & Burton LLP

(57) ABSTRACT

Embodiments of the present disclosure provide for monitoring and supervision of operations that are being performed on a well. The embodiments of the present disclosure provide one or more systems and methods that allow a wellsite supervisor to monitor and supervise from a location that is physically distanced from where the operation is being conducted and, optionally, in real time.

9 Claims, 12 Drawing Sheets

(56) References Cited

U.S. PATENT DOCUMENTS

| | | | | |
|---|---|---|---|---|
| 2017/0051604 | A1* | 2/2017 | Donderici | E21B 47/092 |
| 2018/0135381 | A1* | 5/2018 | Tolman | E21B 33/138 |
| 2018/0230796 | A1* | 8/2018 | Donderici | E21B 47/092 |

OTHER PUBLICATIONS

Written Opinion issued in Application No. PCT/CA2021/051409, mailed on Oct. 6, 2021 (6 pages).

* cited by examiner

SYSTEM AND METHOD FOR MONITORING WELL OPERATIONS

TECHNICAL FIELD

This disclosure generally relates to production of oil and/or gas. In particular, the present disclosure relates to a system and method for monitoring and supervising operations that are performed on an oil and/or gas well.

BACKGROUND

Hydraulic fracturing, also referred to as fracking, is a known operation for stimulating production of oil and/or gas through a well. Briefly, when a wellbore has been drilled, cased and/or lined and optionally cemented, an apparatus that includes a bridge plug assembly and a perforation gun can be introduced into the wellbore by a various approaches including a wireline system, a coiled tubing system and otherwise. If the wellbore has any sections that deviate from substantially vertical, the apparatus can be moved into these segments with the assistance of fluids pumped into the wellbore at the surface, by a downhole tractor, or otherwise. During a typical fracking operation, when the apparatus is in a desired location within the wellbore, a bridge plug is deployed to form a substantially fluid tight seal across the wellbore so that no fluids within the wellbore can pass the bridge plug. Next, the perforation gun unit, which may include a number of individual guns, each carrying multiple, shaped-charges, is activated. When activated, one or more guns can detonate one or more charges to perforate the casing (or liner as the case may be) and any surrounding cement so that between the surface and the bridge plug, the wellbore is in fluid communication with the formation adjacent the wellbore, at the desired location. Each time the apparatus is deployed, activated and returned to surface can be referred to as a run.

Once fluid communication is established, high-pressure fluids can be pumped down the wellbore from the surface and into the formation to create cracks therein. A material, referred to as proppant, is often carried by the high-pressure fluids to the formation from the surface. The proppant can travel into the cracks to hold them open so that oil and/or gas trapped within the formation can flow therethrough and into the wellbore.

Often times, multiple runs of the apparatus are done so the steps of deploying a bridge plug and activating the perforation gun unit are repeated at different locations within the wellbore. Typically, the steps are performed furthest from the surface first and then sequentially performed advancing closer to the surface. So that a number of locations within the wellbore gain fluid communication with different parts of the formation, depending on whether certain bridge plugs are in place or removed, to increase the production of oil and/or gas from the reservoir as a whole.

A plug and perforation operation is a complicated operation that involves multiples instances where high-pressure fluids and charges are used. Furthermore, a plug and perforation operation occurs on a well site (including a well pad) where there may be various other similarly complicated operations occurring. Safety and efficiency are important factors for any wellsite operation; however, current plug and perforation operations rely on unreliable methods for capturing and recording operational information.

SUMMARY

Some embodiments of the present disclosure provide for monitoring and supervision of operations that are being performed on a well. The embodiments of the present disclosure provide one or more systems and methods that generate operational information regarding a plug and perforation operation that is not otherwise available. This operational information allows for users to know where a bridge plug has been set within a well and where one or more charges have been detonated within a well, additionally, combined with other data including the well ID, stage number and additional plug and gun data a Plug and Perf report can be generated automatically. An automatically generated Plug and Perf report can reduce or substantially eliminate the time and cost of manual data entry while improving the accuracy of reports by using sensor derived data to generate those reports. Furthermore, this operational information may be provided in real time, which allows operators to adjust the operation to better follow a predetermined operational plan. Furthermore, because this operational information is available in real time, it allows for proactive adjustments to a subsequent fracking operation. The embodiments of the present disclosure are also configured to provide the operational information to users, including a wellsite supervisor, who are not physically located where a wireline system that is performing the plug and perforation operation is located. This allows for a wellsite supervisor to remotely monitor and supervise the plug and perforation operation from a location that is physically distanced from where the operation is being conducted. This remote access also allows the wellsite supervisor to receive operational information from multiple plug and perforation operations in real time.

Embodiments of the present disclosure provide one or more systems and methods that collect sensory information from various sources that are not collected, aggregated or analyzed together at all. In short, the current state of the art provides various systems that are separate and that otherwise do not share information. Because the information is not shared between the various systems, the operators of a plug and perforation operation rely on assumptions about where an operation event actually occurs in the well receiving the plug and perforation operation. Because the embodiments of the present disclosure collect the sensory information from various sources, the embodiments of the present disclosure can be configured to generate new operational information that is more accurate than what is currently available. Furthermore, the embodiments of the present disclosure allow monitoring and supervision by the wellsite supervisor to occur while the operation is in progress and thereby presenting the new operational information to the wellsite supervisor in real-time where such operational information is provided. This allows a wellsite supervisor the ability to adjust the plug and perforation operation as it is occurring. Additionally, with a complete report of that includes the new operational information, the wellsite supervisor has the ability to proactively adjust a subsequent fracking operation in order to try and compensate for any deviations from the predetermined plug and perforation operational plan. Furthermore, the embodiments of the present disclosure can provide a complete record of all operational information so that future plug and perforation operations can be designed based upon what worked well and what didn't during previous operations.

Some embodiments of the present disclosure allow an authorized user, such as the wellsite supervisor, to set one or more operating thresholds within the systems and methods of the present disclosure that are monitored during the operation. The operating threshold can relate to operating parameters, including but not limited to: pressure in one or more conduits within the wireline system and/or the well, fluid volumes displaced, well depth, position of wireline system components, the number of charges that are fired at each desired location, the position in the well where a charge is fired, the position in the well where a bridge plug is set, the distance between charges within an interval referred to as cluster spacing, the distance between intervals referred to as stage spacing, tension along the wireline, speed at which the wireline is moving within the well, or combinations thereof. Such that if an operating threshold is approached and/or exceeded, the systems and methods of the present disclosure will generate a warning signal to advise at least the wellsite supervisor that the operation is approaching and/or proceeding beyond one or more preset operational thresholds. This provides the wellsite supervisor the ability to supervise the operations in real-time, for example by instructing the wireline operators to adjust one or more steps of the operation in order to increase compliance with a predetermined plan for the operation.

Some embodiments of the present disclosure provide further benefits to the wellsite supervisor to allow for remote monitoring and supervision of operations being performed on a well. These embodiments of the present disclosure provide the ability to: receive operational information from multiple operations as they occur in real time; establish authority loops through which the wellsite supervisor can communicate with the operators of multiple wireline systems (or another operational system) as operating parameters are monitored, whereby such authority loops are required to be satisfied before one or more of the operators can proceed to the next step of the operation; allow the wellsite supervisor to intervene—or cause others to intervene—in the operation; relieve the wellsite supervisor of having to manually record and transcribing the operational information; or combinations thereof.

Embodiments of the present disclosure also provide systems and methods that can decrease the resources required to transport and house wellsite supervisors to a given well and/or well pad.

BRIEF DESCRIPTION OF THE DRAWINGS

These and other features of the present disclosure will become more apparent in the following detailed description in which reference is made to the appended drawings.

DETAILED DESCRIPTION

Figure 1:
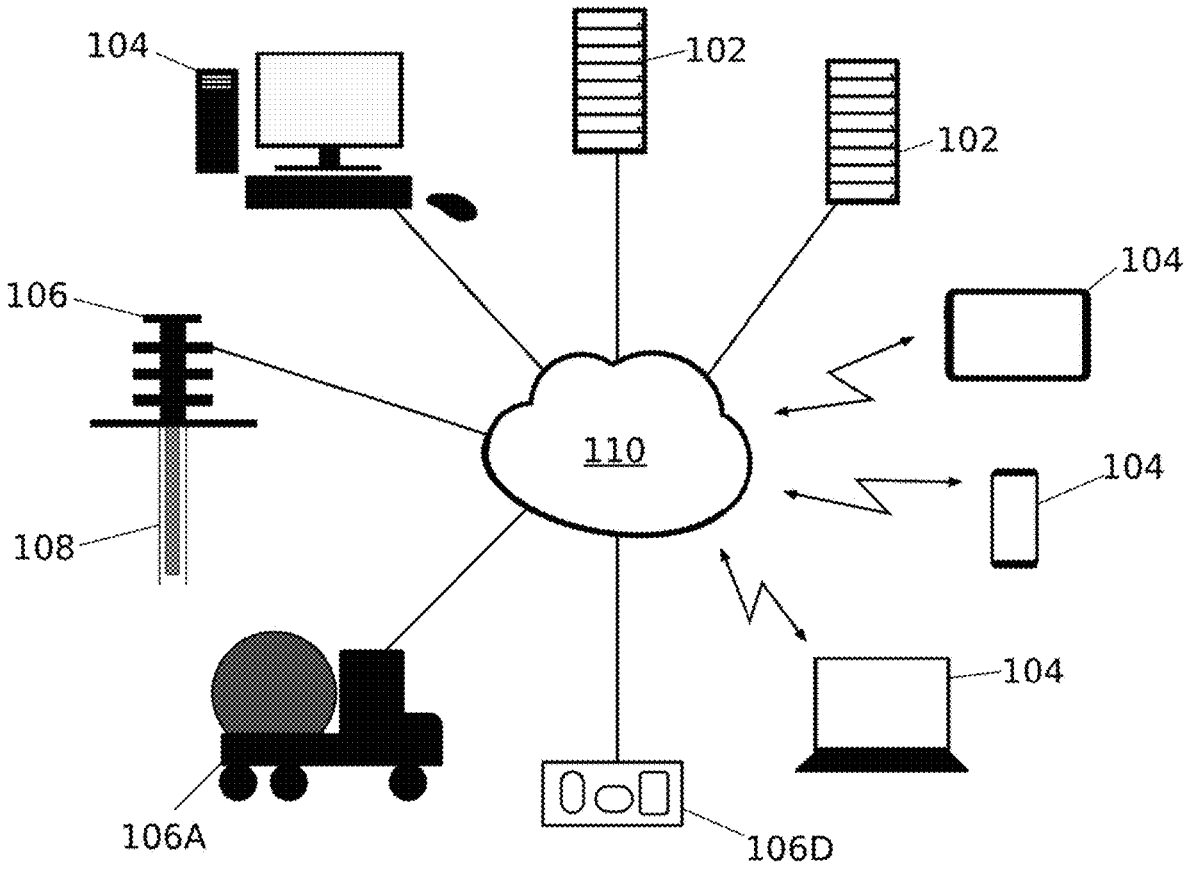
FIG. 1 is a schematic diagram of a system, according to embodiments of this disclosure, for monitoring an operation being performed on an oil and/or gas well.

Embodiments of the present disclosure relate to systems and methods for monitoring and supervising an operation that is being performed on an oil and/or gas well. In some embodiments of the present disclosure the operation is one or more of a completion operation, a workover operation or a stimulating operation. In some embodiments of the present disclosure, the operation is a stimulating operation that includes one or more fracturing steps. In some embodiments of the present disclosure, the one or more fracturing steps include a step of perforating and plugging a wellbore. The step of perforating and plugging the wellbore includes the steps of introducing an apparatus into the well, the apparatus includes one or more deployable bridge plugs and a perforating gun assembly. The one or more fracturing steps includes the steps of deploying a bridge plug within the well proximal to a first desired location, positioning the perforating gun assembly at a first desired location within the wellbore, and detonating one or more charges upon the perforating gun at the first desired location. As will be appreciated by those skilled in the art, "firing a perforation gun" as a concept is used herein but it also contemplates other apparatus and systems for providing fluid communication across a wellbore tubular, such as wellbore casing, liner, pipe or combinations thereof. Examples of such apparatus and systems include, but are not limited to: mechanical perforating tools that punch a hole in the wellbore tubular; mechanical cutting tools that cut a hole into the wellbore tubular; chemical cutting tools that open a hole in the casing; mechanically activated devices positioned within the wellbore tubing string, for example a sleeve that may be opened or closed via wireline or other mechanisms; downhole deflagration and/or detonation systems; and, other mechanisms for making a hole or opening in the wellbore tubular for fracturing fluids to be pumped therethrough and to communicate with the surrounding environment.

In some embodiments of the present disclosure, the apparatus is introduced, positioned and operated within the wellbore by a wireline system. The wireline system includes a wireline truck with a spool for introducing (and retrieving) wireline into a well. The wireline truck may further include one or more sensors that provide data regarding the wireline system including, but not limited to: depth that the wireline has reached, speed at which the wireline is moving (either into or out of the well), tension of the wireline, casing collar locator data or combinations thereof.

Typically, there are different systems by which the apparatus is activated and the actions of the bridge plug assembly and the perforating gun assembly are controlled and monitored. For example, a fire computer system is managed by the user who is in charge of activating the assembly. The fire computer system sends electrical signals from surface to the bridge plug assembly for setting a bridge plug and to the perforating gun assembly for activating one or more of the guns at a time. The fire computer system can apply a digital time-stamp to each time that an electrical signal is sent to the perforating gun assembly, or not. Typical and known fire computer systems do not provide any further specific data, such as the position of the perforating gun assembly when it is activated, any operational information regarding the plugs or guns upon the perforation assembly, or any meta data associated with activity or functionality of the fire computer system.

The wireline system is another system that can monitor the actions of the apparatus. The wireline system delivers the assembly into and out of the well and it can include a wireline data acquisition system that receives data from one or more sensors that are part of the wireline system. Typical wireline data acquisition systems receive at least the following operational information from one or more sensors: the amount of wireline that has been deployed, the speed at which the wireline was deployed, the tension on the wireline and downhole positional data provided by a casing collar location (CCL) system. The amount of deployed wireline data and the CCL system data may be correlated to provide a depth value of the perforation assembly.

Furthermore, a manual log system is also used to record the operation being performed on a well. The manual log system is updated by an individual who is present on the well site and, typically, who is operating the equipment performing the plug and perforation operation. The manual log system is supposed to capture at least the following operational information: confirm if the wireline system is configured with the correct set of bridge plugs and the perforating gun assembly; when the fire computer system is used to set a bridge plug; whether a given bridge plug is set at the desired depth within the well; and, whether the perforating gun assembly is activated properly and at the desired depth within the well. The manual log system; however, is merely a record of the planned plug position or planned shot depth or a manual reading of measured depth at an approximate time of setting a plug or firing a shot and typical manual log systems do not record the actual depth/position where a plug is set or the actual depth/position where a gun is fired. The individual user who is operating the wireline truck may employ several methods for setting the bridge plug or firing the perforation assembly at the correct depth including a "retrieve-pause-fire" approach whereby the wireline operator will retrieve the perforation assembly to the desired depth, pause, and fire the perforation assembly or a "fire on-the-fly" approach whereby the wireline operator will set the wireline truck to retrieve the perforation assembly at a given speed and will attempt to fire the perforation assemblies at the planned depth as the toolstring assembly is being retrieved. The "fire on-the-fly" approach is often preferred as it is the fastest method for completing the perforation task, however, neither of these methods necessarily record the actual plug or shot depth as they rely on accurate human inputs.

Typically, both a wireline system operator and a wellsite supervisor each record operational information in their own manual log system, however, in some scenarios only one manual log is generated. It is often the responsibility of the wellsite supervisor to transcribe their manual log into a well-data repository. This approach requires that the wellsite supervisor be physically present at the well and physically in proximity where the operations are being conducted in order to capture the operational information. Both steps of: (i) memorializing the operational information within the manual log; and, (ii) transcribing the manual log into the well data repository can be monotonous and prone to human error, which can result in an incorrect record of the operational information within the well-data repository. The well-data repository is used to capture all information regarding a well, including well plans, operational plans, drilling operations, completion operations, testing operations, stimulation operations and workovers. If any information is inaccurate or incorrect in the well-data repository, that could have implications on how the well is managed and how other well operational plans are developed. As discussed further below, the embodiments of the present disclosure are configured to receive operational plan information, including operational specification of all plugs and guns upon the perforation assembly, and sensory information regarding the depth of the perforation assembly, in order to automatically generate a report of what depth (or position within a well) that a plug is actually set or what depth a gun (or given charge of a gun) is actually fired.

A review was performed of the manual data entry of operational information into a manual log was performed for a single well that received 36 plug and perforation runs where the apparatus included 9 charge detonations and one bridge plug setting per stage. This review found that 10, 224 data points were entered manually. This number was calculated based on each gun having 30 manual entries and each plug had 14 manual entries. Some reports indicate that this manual logging can take between about 2.5 to 5 hours of an individual's day to perform. The following manual input errors were observed: one instance of depths for a stage were entered in reverse order; three instances of CCL depth entered instead of "Top Shot" depth; two instances of Gun Depth not entered; one instance of the incorrect Gun Details were used for a stage. It is also worth noting that these incorrect data points are often used in calculations for further data points, and so those calculated data points are also incorrect because they are based off of incorrect input data.

In contrast, the embodiments of the present disclosure provide systems and methods that are configured to collect data from the fire computer system and the wireline system and these embodiments of the present disclosure convert the formatting/language of these two different data sources and create a new point of operational information—also referred to as operational information. The new operational information comes from correlating the data points from the fire computer and the wireline systems together to establish an actual depth value within the well where a bridge plug was set or where a charge was detonated. This new data point can be included in a plug and perforation report that can be in a format that is compatible with existing well databases. Some embodiments of the present disclosure can reduce the 2.5-5 hours of manual data input (as described above) to 15 minutes of data review/verification and uploading.

For example, when a charge is to be detonated, the wireline operator will start a firing window within the fire control system as they see that the depth of the apparatus, based upon the information provided by the casing collar locator system, is approaching a predetermined depth within the well. The operator will then initiate a fire sequence (i.e. an electrical signal is sent from the surface down the wireline to the apparatus) in an effort to have the one or more charges detonate at the predetermined location. When the fire sequence is initiated, the fire control system creates a new charge fire file that is saved to a local disk. When the new charge fire file is saved, the embodiments of the present disclosure are configured to detect the creation of the new charge fire file and then extract specific information, such as a fire control system created time stamp and any mis-fire data, from the charge fire file. Some embodiments of the present disclosure are configured to extract sensor information directly from the applicable sensors, or indirectly through the fire control system, either in addition to other extracted data or not. For example, the embodiments of the present disclosure may extract and monitor current, voltage and/or tension values from the applicable sensors. A detected increase in voltage and/or current that is followed by a drop in either, or both, can establish a pattern in the sensor information may be interpreted as an event of when a plug has been set or a gun has been fired. In conjunction with, or independent from, the extracted voltage and current information, and analysis of any patterns therein, a decrease in tension can also provide a further pattern that indicates when a plug has been set. The extracted specific information can include the time the charge fire file was created, a detected pattern in applicable sensory information or both. In some embodiments of the present disclosure, the physical fire control panel may be equipped with a further sensor to detect when a specific button or switch is actuated in order to set a plug or fire a gun and the further sensor will generate a fire signal that is sent to the system 100. Next, the embodiments of the present disclosure apply a time offset to this measured time for synching the charge fire file creating time within the embodiments of the present disclosure. Next, the embodiments of the present disclosure collect further operational information from the wireline system. For example, the embodiments of the present disclosure will request the wireline system for data (at a sample rate of multiple times per second, for example about 10 samples per second or more or less frequently) that aligns with the synched time point to create a further data point. The wireline system data may include the stage where the charge was detonated, the shot number, the date, the time and the top depth. For example, the embodiments of the present disclosure may correlate and or synch the charge fire file time stamp with the wireline system data timestamp to create the further and new data point that may include further information from the operational plan module 405, including but not limited to: carrier description, carrier make, charge make, charge size, charge type, conveyance method, top depth, bottom depth, date of the run, cluster reference number, explosive type, gun centralized or not, gun description, gun left in hole, gun metallurgy, gun size, interval number, orientation, orientation method, phasing, shot density, shot plan, shot total, intended perforation hole size, nominal perforation penetration, gun type or combinations thereof. The embodiments of the present disclosure may be configured to receive and store this further information for such correlating steps. This automated correlation of the fire control system generated data (time stamp of when gun is fired or plug is set) and the wireline system data (depth of CCL and time stamp of that depth) to create new operational information (based upon a toolstring offset value) for determining the actual depth at which a given gun is fired or a given plug is set. This automated correlation is not performed during typical plug and perforation operations. This automated correlation of when a given shot is fired (or a given plug is set) and what the depth of the perforation assembly at the time the shot was fired (or plug is set) is based upon actual sensor data (rather than inaccurate manually entered data or assumptions made by users when entering data—as typically happens when a retrieve-pause-fire approach or the fire on-the-fly approach are used), that is captured automatically for creating an output report that can be shared with other databases. The embodiments of the present disclosure may also collect well identification information so that the user will know which well is receiving a plug and perforation operation and so that the correct predetermined operational plan information is utilized.

For example, the collected further operational information from the wireline system may include depth information of the apparatus within the well from the wireline casing collar locator (CCL) log information. Next, the embodiments of the present disclosure associate the time information with the depth information to create a single time and depth information point. Next, the embodiments of the present disclosure are configured to calculate an actual depth value based upon where the specific charge that was detonated is positioned relative to where the CCL system is located on the perforation apparatus. This positional information may be referred to as a tool sting offset and each charge and bridge plug that are deployed on the apparatus have a toolstring offset value to reflect the distance that each component is positioned relative to the CCL system. The toolstring offset value for a charge may be a top depth value for each charge, which is the distance from the middle of the CCL system to the top of the charge. The toolstring offset value may also be the bottom depth value for each charge, which is the distance from the middle of the CCL system to the bottom of the charge. The toolstring offset value may be an average of the top depth and the bottom depth values for a given charge. For example, an apparatus may be deployed with 9 guns and 1 plug, each gun includes one or more charges. In this example, the toolstring offset values for these 9 guns and plug may be: plug—23 feet from the CCL system, gun 1-15 feet from the CCL system, gun 2-12 feet from the CCL, gun 3 11 feet from the CCL, gun 4-10 feet from the CCL, gun 5-8 feet from the CCL, gun 6-7 feet from the CCL, gun 7-5 feet from the CCL, gun 8-2 feet from the CCL and gun 9-9 feet from the CCL. Each of the 9 guns, their respective charges and the plug will have a toolstring offset value.

Some embodiments of the present disclosure may be configured to perform a toolstring offset calculation based upon the physical measurements and specification of the various tools (guns or plugs) built into the perforation assembly: the center of the CCL to the top of the first shot on the perforation apparatus (CCL to TS) and the distance from the bottom of the last shot on the perforation apparatus to the top of the plug (BS to Plug). Next the length of each gun is extracted from the gun library data 810 and used to calculate the toolstring offset values for each gun and any applicable plugs (using the plug library data 808). For example, on a perforation assembly with 9 guns and one plug, the tool offset value may be calculated as follows: Gun 9=CCL to TS; Gun 8=Gun 9 value+length of Gun 9; Gun 7=Gun 8 value+length of Gun 8; Gun 6=Gun 7 value+length of Gun 7; Gun 5=Gun 6 value+length of Gun 6; Gun 4=Gun 5 value+length of Gun 5; Gun 3=Gun 4 value+length of Gun 4; Gun 2=Gun 3 value+length of Gun 3; Gun 1=Gun 2 value+length of Gun 2; and Plug=Gun 1 value+length of Gun 1+BS to Plug value. The toolstring offset calculation is based upon actual physical spacing of the guns and plugs upon a given perforation apparatus and, therefore, it is more accurate than estimates that users typically employ in the field during well operations.

The embodiments of the present disclosure may also collect operational information from a predetermined operational plan that will inform as to which gun should have been fired at a given CCL depth so that the correct toolstring offset value can be applied to create an accurate actual depth value.

As such, when the embodiments of the present disclosure collect the time information (from the fire control system) of when a gun is fired, collect the CCL depth of where the gun was fired (from the wireline system), and then apply a toolstring offset value for the individual gun that was fired, the actual depth value is created that indicates where a charge was fired in the well. The actual depth value informs users, including the wellsite supervisor, of the actual position where a gun was fired, rather than the planned position and can also be used to generate an actual job data report of the Plug and Perforation operations. In contrast, the state of the art typically only provides a time a gun is fired and a CCL depth value.

The embodiments of the present disclosure also relate to providing an actual depth value of where a bridge plug is set. When setting a bridge plug, the operator will use the fire control system to initiate a plug fire sequence (i.e. an electrical signal is sent from the surface down the wireline to the apparatus) in an effort to have the bridge plug set at the predetermined location based upon the CCL positional information available. When the fire sequence is initiated, the fire control system creates a new plug fire file that is saved to a local disk and, as described above, the embodiments of the present disclosure will detect that a new plug fire file has been created and extract operational information from the plug fire file, such as what time was the plug set and/or sensory information patterns to assess when the plug was set (or gun fired). The embodiments of the present disclosure may then create a new time stamp that synchs the time stamps created by two or more systems (for example a time stamp created by a fire control system and a depth and timestamp created by a wireline data acquisition system) to create a common and new time stamp that indicates when the plug setting or gun firing event occurred. The embodiments of the present disclosure then collect further operational information from the wireline system such as, but not limited to: plug type, condition run, top depth, bottom depth, description, date run, time run, icon name, make, model, size (ID), size (OD), comments, or combinations thereof.

In addition to logging and transcribing the operational information, the wellsite supervisor has various other duties to perform including, but not limited to: confirming whether or not the plugging and perforating operation occurred as designed and overseeing that various well operations are being conducted safety. If not, there can be significant implications on the productivity of the well, operating costs and there can also be significant safety risks that arise. For example, if a charge does not detonate at the desired location that charge may detonate at an undesired location, including within the well and possibly at the surface. However, oftentimes the wellsite supervisor does not have all the operational information to assist them during the operation and oftentimes the wellsite supervisor will only review all of the operational information as a complete dataset when the operation is complete, if ever. At that time, it is too late to make any adjustments in the plug and perforation operation and the wellsite supervisor will often assume that the plug and perforation operation proceeded according to the predetermined operational plan. For example, a predetermined plug and perforation operational plan will include a shot sheet. The shot sheet is a physical document that may include: Shots Per Foot, Gun Length, Top Shot—the intended depth at which the wireline operator is to fire the shot or set the plug, top shot—which equals the casing collar locator (CCL) depth plus the measured distance from the CCL to the top of the gun or plug to be used at a specific stage, CCL depth is the corrected/adjusted depth of the CCL and this is the depth measurement that a wireline system operator may record/use. During a plug and perforation operation, plugs can be deployed when the apparatus is stationary in the well. However, when detonating one or more changes, the apparatus can be stationary or moving. This can result in the wireline operator setting a plug or detonating a charge at the wrong depth in the well. For example, if a wireline system operator attempts to detonate a charge while the apparatus is moving out-of-hole at a speed of 60 ft/min. If they delay or miss their depth by 1 or 2 seconds this can result in the charge being detonated off the mark by 1 or 2 ft. Over the course of the perforation steps in a given stage, this inaccuracy in where perforations are created can cause problems. Furthermore, the charges are detonated and the bridge plugs are typically deployed based on the CCL depth value and not the actual depth position of the charge or plug in the well.

The shot sheet may require that all charges in a given stage are to be equally spaced out over a 200 foot distance. If the charges are fired as intended and are equally spaced over the 200 ft distance then the subsequent fracturing operation will be applied over the 200 ft distance, the designed proppant load and pumping rates should perform as intended by the predetermined operational plan.

However, if the charges are not detonated according to the predetermined operational plan and are instead bunched closely together then the same fracturing work with the same proppant load and pumping rates will be applied to only a small section of the wellbore. This may result in only a small part of the intended 200 ft section of the wellbore being fractured, and that smaller section will have been fractured higher than expected fracturing pressures. This may cause an increased risk of sanding off/screen out (too much sand pumped into one part of the formation causing a build up of sand and even a sand bridge/plug) and poor long term performance of the well as. Alternatively, if the perforations are too far apart, that too can negatively impact efficacy of the fracturing operation.

Furthermore, once the fracturing operation is complete the plugs must be drilled out. It is important for the rig performing the drill-out work to know the location of the plugs within the well. If the plug was set higher than actually recorded then the drill-out rig may inadvertently crash into a plug causing damage to the drilling toolstring. If the plug is set lower than recorded then there will be a loss of time and reduction in efficiency as the drill-out rig will slow down long before encountering the plug.

When performing analysis of a plug and perforation operation later if the incorrect plug and perforation information is provided then the analysis will result in incorrect findings that may have larger implications on designing future plug and perforation operations and future fracturing operations.

Without being bound to any particular theory, the manner by which the embodiments of the present disclosure create the actual depth values for where one or more charges are detonated and where a bridge plug is set may provide a number of practical benefits to wellsite supervisors. The actual depth values are more accurate than what is provided by the state of the art and they are created in real time. The implications of which are that a wellsite supervisor can make an adjustment to the plug and perforation operation as it is occurring. In contrast, the state art merely provides manual log data that is entered into a well-data repository. Not only is the manual data entry time consuming and inaccurate but it does not occur in real time, meaning that adjustments to the plug and perforation operation is less likely to occur, if at all. Furthermore, because the actual depth values are created in real time, this affords the wellsite supervisor the opportunity to adjust a predetermined fracturing plan based upon where the perforations are actually made in the well. For example, if the perforations are too close in a given stage, then the wellsite supervisor may adjust one or more fracturing operational parameters such as: changing the amount of proppant in the fracturing fluids or changing the fracturing fluid pressure. If the perforations are too close together, the wellsite supervisor may determine that it is preferred to re-perforate one or more stages. These decisions about possible adjustments to the fracturing operation are important so that the time and resources that are invested in the fracturing operation are optimally employed. In practice, the window in which to make any adjustments of the perforation operation based upon the plug and perforation operation is between when the plug and perforation operation is complete and when a fracturing operation can begin and this window can be within 1-3 hours or less. Without receiving the actual depth values in real time, the wellsite supervisor would be forced to perform the manual data entry task before they would be in any position to analyze the operational information from the plug and perforation operation to assess whether or not the fracturing operation should proceed as planned. Furthermore, that assessment would only be based upon the planned position of where each charge should have fired and the planned position of where each bridge plug should have been placed.

The embodiments of the present disclosure also enable remote operations is also a benefit. Previously, the wellsite supervisor would have to physically be present at the wellsite where the plug and perforation operation is occurring to verify that the charges are detonated and the plugs are set according to the predetermined operational plan. Then the wellsite supervisor, would then have to spend time manually entering that information that they personally verified into a well data repository. This is inefficient use of a highly skilled person's time and it also requires a dedicated wellsite supervisor be present at all wellsites where plug and perforation operations are occurring. Because well sites are often in very remote locations a great deal of resources must be utilized to transport these individuals to each well site, house them near the well site and to provide a safe well site for all of the individuals to work at. Furthermore, because operations often run twenty-four hours, multiple individuals are required at the well site to cover all shifts. In contrast, the embodiments of the present disclosure relate to methods and systems that provide real-time operational information to a wireline supervisor and other authorized users that can be remote from the geographic location where the well operation is being performed. This allows a single supervisor to monitor and supervise multiple well operations that may be occurring at different and geographically spaced apart locations.

Embodiments of the present disclosure will be described further below with reference to the figures, which show representations of a system and method according to the present disclosure that provide for actual depth values for detonated charges and set bridge plugs. The actual depth values are provided in real time and they can be distributed to wellsite supervisors who do not need to be physically located proximal to the operation, which means that one supervisor can monitor and supervise multiple plug and perforation operations at multiple wellsites.

FIG. 1 shows one embodiment of a system 100 for monitoring an operation that is being performed on an oil and/or gas well 108. The system 100 includes various hardware components, including not limited to: one or more server computers 102 (also referred to herein as a server), one or more client-computing devices 104, and one or more operation devices 106, 106A, 106D. The system 100 is configured for one or more users to monitor the progression of an operation that is being performed on a well 108.

The one or more users can include one or more operators, such as but not limited to: a wireline system operator, a pump-down pump operator, a wellhead valve operator, a fracturing system operator, a provider of another well service that is being provided in conjunction with the operation or combinations thereof. Typically, the one or more operators are physically present at the site where the well 108 is located in order to perform the operation or to provide any other applicable well service.

The one or more users also includes a wellsite supervisor, also referred to herein as a wellsite supervisor. A wellsite supervisor, also referred to as a supervisor, is an individual who is responsible for the operation being performed on the well 108 according to the operational plan and, often times, the safety and efficiency of all other operations being performed on the 108, the well site and/or well pad. In some instances, the supervisor is responsible for multiple operations being performed on multiple wells that may be at the same well site/pad or not. As such, the supervisor can be physically present at the wellsite of the well 108, or not. If the supervisor is physically present at the well site, they can be physically located at a different location than the components that are at the wellsite to perform the operation. For example, when using the system 100 the supervisor need not be physically present within a wireline truck or near to a fire control panel when the operation being performed on the well 108 is a wireline-deployed, plug and perforation operation.

The one or more server computers 102, one or more client-computing devices 104, and one or more operation devices 106 are functionally interconnected by a network 110, such as the Internet, a local area network (LAN), a wide area network (WAN), a metropolitan area network (MAN), or combinations thereof via suitable wired and wireless networking connections.

Each server computer 102 executes one or more server programs. The server computer 102 may be a dedicated server and/or a general-purpose computing device which may be used by a user while acting as a server.

All users of the system 100 can receive and transmit information and data through the system 100 via an individual client-computing device 104. The client-computing devices 104 may each be a desktop computer, a laptop computer, a tablet, a smartphone, a Personal Digital Assistants (PDAs) or combinations thereof. Each client-computing device 104 executes one or more client application programs for use by each user.

Figure 2:
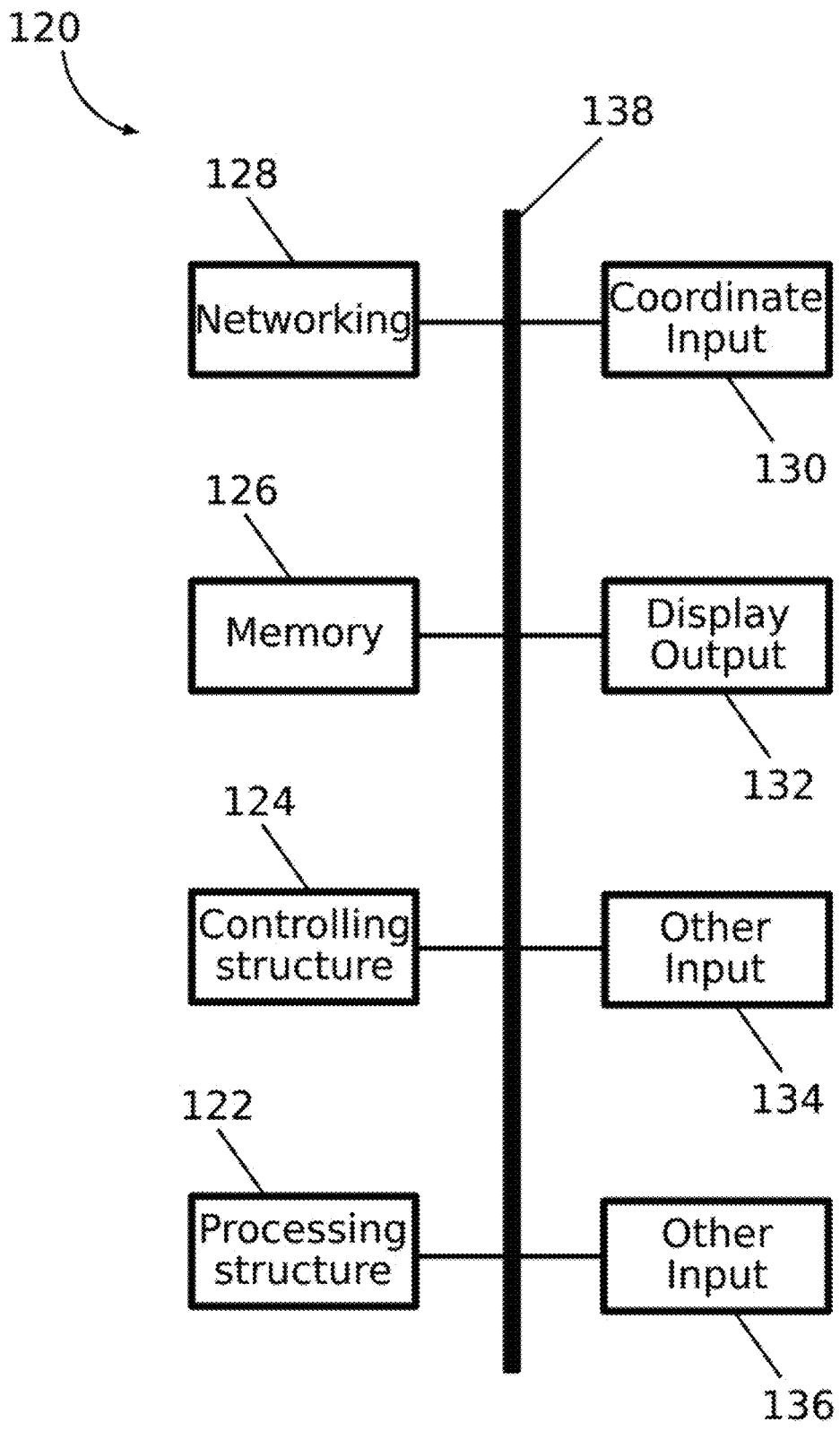
FIG. 2 is a schematic diagram of a hardware structure of a computing device of the system of FIG. 1.

The computing devices 102 and 104 may have a general hardware structure 120 such as is shown in FIG. 2. Generally, computing devices 102 and 104 includes a processing structure 122, a controlling structure 124, memory or storage 126, a networking interface 128, a coordinate input 130, a display output 132, and other input and output modules 134 and 136, all of which are functionally connected by a system bus 138.

The processing structure 122 may be one or more single-core or multiple-core computing processors and are preferably microprocessors such as INTEL®, ARM®, AMD® architectures or combinations thereof.

The controlling structure 124 includes a plurality of controllers such as graphic controllers, input/output chipsets or combinations thereof, for coordinating operations of various hardware components and modules of the computing device 102/104.

The memory 126 includes a plurality of memory units. The processing structure 122 and the controlling structure 124 may read and/or store data, including input data and data generated by the processing structure 122 and the controlling structure 124, to these memory units. The memory 126 may be volatile and/or non-volatile, non-removable or removable memory such as RAM, ROM, EEPROM, solid-state memory, hard disks, CD, DVD, flash memory or combinations thereof. In use, the memory 126 is generally divided into different sections for different purposes. For example, a section of the memory 126 (denoted as storage memory herein) is for long-term data storing, such as storing databases or files. Another section of the memory 126 is for storing data during processing, which can also be referred to as working memory. The networking interface 128 includes one or more networking modules for connecting to other computing devices or networks through the network 110 by using wired or wireless communication technologies such as Ethernet, WI-FI®, BLUETOOTH®, ZIGBEE®, 3G and 4G wireless mobile telecommunications technologies, or combinations thereof. In some embodiments of the present disclosure, parallel ports, serial ports, USB connections, optical connections, or combinations thereof can be used for connecting with other computing devices or networks; however, these connections can also be considered as input/output interfaces for connecting input/output devices.

The display output 132 includes one or more display modules for displaying images to a user. Display modules include but are not limited to: monitors, LCD displays, LED displays, projectors or combinations thereof. The display output 132 may be a physically integrated part of the computing device 102/104 (for example, the display of a laptop computer or tablet), or the display output 132 may be a display device that is physically separate from but functionally coupled to other components of the computing device 102/104. For example, display output 132 can be the monitor of a desktop computer. The display output 132 is configured to display graphic and/or text reports from the system 100 for the user to receive operational display information, including warnings, as described further below.

The coordinate input 130 includes one or more input modules for one or more users to input coordinate data, such as touch-sensitive screen, touch-sensitive whiteboard, trackball, computer mouse, touch-pad, or combinations thereof. The coordinate input 130 may be a physically integrated part of the computing device 102/104 (for example, the touch-pad of a laptop computer, the touch-sensitive screen of a tablet or combinations thereof), or the coordinate input 130 may be a display device that is physically separated from but functionally coupled to other components of the computing device 102/104 (for example, a computer mouse). The coordinate input 130 in some implementations may be integrated with the display output 132 to form a touch-sensitive screen or a touch-sensitive writing board.

The computing device 102/104 may also include other input devices 134 such as keyboards, microphones, scanners, cameras, speakers, printers, or combinations thereof. In some embodiments of the present disclosure, at least one client-computing device 104 may also include a positioning component such as a Global Positioning System (GPS) component for determining the position thereof. Optionally, at least one client-computing device 104 is functionally coupled to an external GPS device for determining the position of the client-computing device 104.

The system bus 138 interconnects various of the components 122 to 136 and the system bus 138 is configured to enable these components to transmit and receive data and control signals to and from each other.

In some embodiments of the present disclosure, the operation is a stimulating operation that is performed on one or more oil and/or gas wells. The operation can include one or more fracturing steps. In some embodiments of the present disclosure, the one or more fracturing steps include a step of perforating and plugging the well 108. The step of perforating and plugging the wellbore includes the step of introducing an apparatus into the well 108, the apparatus includes one or more deployable bridge plugs and a perforating gun assembly. The perforating and plugging step includes the steps of deploying a bridge plug within the well 108 proximal to a first desired location, positioning the perforating gun assembly at a first desired location within the wellbore, and detonating one or more charges upon the perforating gun at a first desired location within the well 108. A desired location may also be referred to herein as a predetermined location. In some embodiments of the present disclosure, the apparatus is introduced into, positioned and operated within the well 108 by a wireline system 106A. The wireline system 106A includes a wireline truck with a spool for introducing (and retrieving) wireline into (and from) the well 108.

The well 108 can have a substantially vertical wellbore with or without non-vertical sections.

Figure 3:
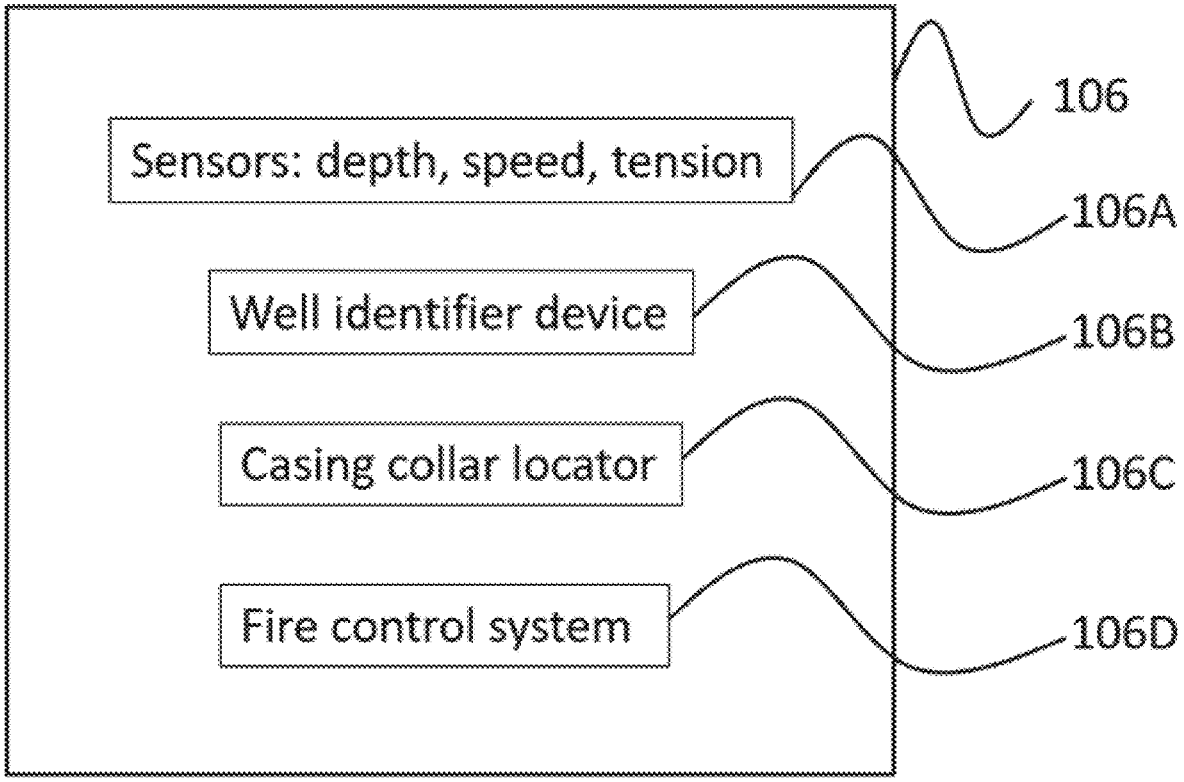
FIG. 3 is a schematic diagram of operational hardware components of a computing device of the system of FIG. 1.

FIG. 3 shows a non-limiting example of systems and hardware that form operational components 106 of the system 100 for monitoring the operation being performed on the well. The operational components 106 include one or more of, but not limited to: one or more sensors of the wireline system 106A, a well-identifier source 106B, a casing collar locator system 106C, or a fire control system 106D. As will be appreciated by those skilled in the art, each of these components of the system 100 are typically separate from each other and not configured to be interconnected with each other as they are in the embodiments of the present disclosure.

The wireline system 106A includes a wireline truck that may further include one or more sensors that provide data regarding the wireline including, but not limited to: depth that the wireline has reached, speed at which the wireline is moving (either into or out of the well), tension of the wireline or combinations thereof.

The well identifier source 106B can be a component that is physically connected to the well 108 that is receiving the operation. The well identifier source 106B can be a variety of devices that generate a signal that is receivable by the system 100 for identifying which well 108 is receiving the operation. For example, the well may be located on a well pad with multiple wells that are each receiving different operations and the well identifier source 106B allows the system 100 to identify which well is receiving the operation. Examples of such well identifier devices 106B include sensors that identify if a well: has a wireline lubricator connected thereto, has other components that relate to other well operations connected thereto; or combinations thereof including one or more of a real-time locator system, a global positioning locator system; a proximity sensory system; an acoustic sensory system; a radio frequency identifier system; a light detection and ranging (LIDAR) system; a machine vision system; the well identifier devices and the magnetic sensor apparatus described in PCT/CA2019/050890, the entire contents of which are incorporated herein by reference, or combinations thereof. The well identifier source 106B can also be an operational information input into the system 100, as discussed further below.

Typically, the casing collar device 106C is used to provide data at the surface that can be manually referenced against prior logs and well data to assess the depth into the well that the apparatus upon the wireline has achieved.

In some embodiments of the present disclosure, the fire control system 106D includes a client-computing device 104, as described above. The fire control system 106D is configured to send electrical signals, via the wireline, to fire the charges upon the perforating gun. The fire control system 106D can provide a variety of information and data to the system 100, including a digital time-stamp as to when an electrical signal was sent to fire a charge, the specific charge that was intended to be fired, the total number of charges that were fired or combinations thereof.

Figure 4:
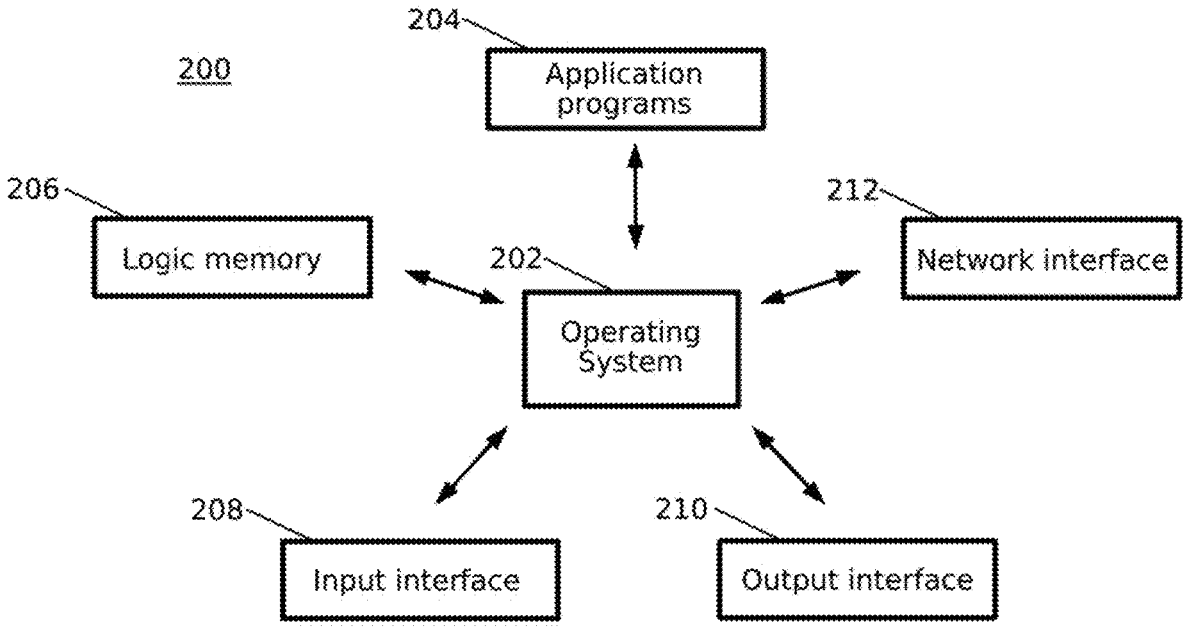
FIG. 4 is a schematic diagram of a simplified software architecture of a computing device of the system shown in FIG. 1.

FIG. 4 shows a simplified software architecture 200 of the computing device 102/104. The software architecture 200 includes an operating system 202, one or more application programs 204, logic memory 206, an input interface 208, an output interface 210, and a network interface 212.

The operating system 202 manages various hardware components of the computing device 102/104 via the input interface 208 and the output interface 210, manages logic memory 206, manages network communications via the network interface 212, and manages and supports the application programs 204, which are executed or run by the processing structure 122 for performing various tasks.

As will be appreciated by those skilled in the art, the operating system 202 may be any suitable operating system such as MICROSOFT® WINDOWS®, APPLE® OS X, APPLE® iOS, Linux, ANDROID®, or combinations thereof. The computing devices 102/104 in the system 100 may all have the same operating system, or may have different operating systems.

The input interface 208 includes one or more input-device drivers managed by the operating system 202 for communicating with respective input devices including the coordinate input 130 and other input 134. The output interface 210 includes one or more output-device drivers managed by the operating system 202 for communicating with respective output devices including the display output 132 and other output 136. Input data received from the input devices via the input interface 208 may be sent to one or more application programs 204 for processing. The output generated by the application programs 204 may be sent to respective output devices via the output interface 210.

The logical memory 206 is a logical mapping of the physical memory 126 for facilitating access by the application programs 204. In this embodiment, the logical memory 206 includes a storage memory area that is usually mapped to non-volatile physical memory, such as hard disks, solid state disks, flash drives, or combinations thereof, for generally long-term storage of data therein. The logical memory 206 also includes a working memory area that is generally mapped to high-speed, and in some implementations volatile, physical memory such as RAM, for the operating system 202 and/or application programs 204 to generally temporarily store data during program execution. For example, an application program 204 may load data from the storage memory area into the working memory area, and may store data generated during its execution into the working memory area. The application program 204 may also store some data into the storage memory area as required or in response to a user's command.

A server computer 102 or a client-computing device when acting as a server computer 102 generally includes one or more server application programs 204, which provide server-side functions for managing the system 100.

In general, a client-computing device 104 includes one or more client application programs 204. A client application programs 204 provides client-side functions for communicating with the server application programs 204, displaying information and data on the graphic user interface (GUI) thereof, receiving user's instructions, and collaborating with the server application programs 204 for managing the system 100.

Figure 5:
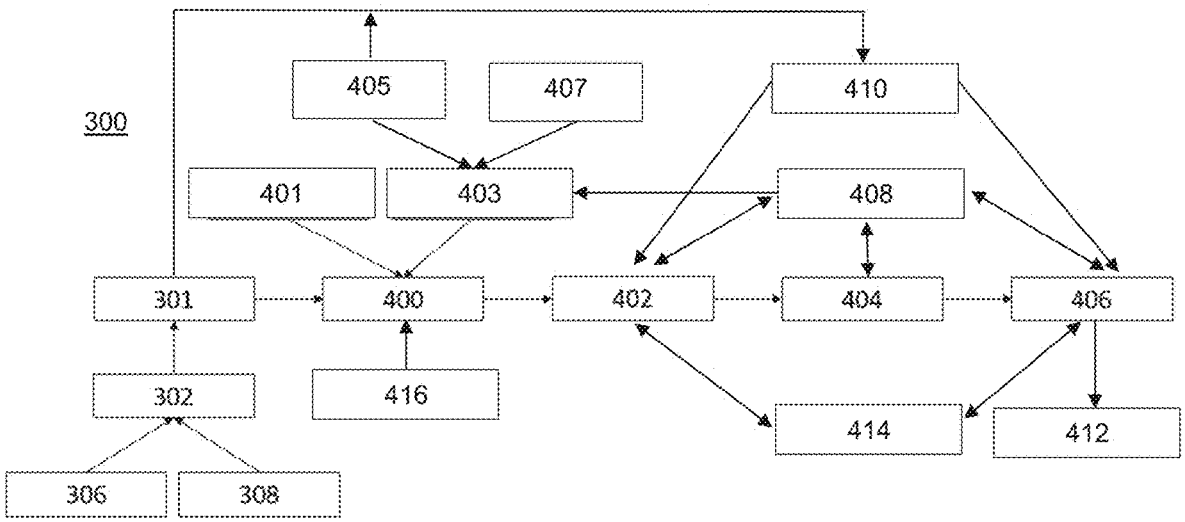
FIG. 5 is a block diagram illustrating a functional structure of the system shown in FIG. 1.

FIG. 5 is a block diagram showing a functional structure 300 of the system 100. The functional structure 300 may be implemented by one or more server application programs and/or one or more client application programs, which are generally referred to as modules herein.

In the functional structure 300, the system 100 includes a plug and perforation module 301, a processor device 400, an operator module 402, a remote system module 404 and a wellsite supervisor module 406. FIG. 5 also shows an optional handshake module 408 and a monitoring module 410, as will be discussed further below. Each of these modules of the system 100 are applications programs 204 that require hardware components for: sending information, data or signals; detecting information, data or signals; communicating information between the system components; determining if operational parameters are being complied with; storing information and data; and facilitating that the supervisor is able to access the system 100 and receive information, data and signals in real-time while remote from where the operation is being performed on the well 108.

The plug and perforation module 301 is configured for monitoring and recording operational information, such as when the apparatus that carries the bridge plug assembly and the perforating gun assembly is activated. The operational information may further include specific data regarding whether or not an electrical signal was sent to the assembly to set a bridge plug from the bridge plug assembly. The operational information may further include specific data regarding whether or not an electrical signal was sent to the assembly to detonate one or more charges. The module 301 can receive operational information from a first interface 302 that receives information from one or both of a control fire module 306 or a wireline system data acquisition system 308. As shown in FIG. 3, the fire control hardware 106D can provide operational information regarding if an electrical signal was sent to the assembly to set a bridge plug or a gun was activated to detonate one or more charges and a digital-time stamp for such electrical signals to the control fire module 306. The depth, speed and tension sensors 106A can each provide operational information to the data acquisition system 306 regarding the length of wireline that has been unspooled from the wireline truck, the speed at which the assembly was moved within the well and the tension across the wireline. Optionally, the casing collar locator 106C system can provide operational information to the data acquisition system 308 regarding where the apparatus is located in the well.

The plug and perforation module 301 collects operational information obtained by the first interface 302 and sends the collected operational information to the processor device 400 or directly to one or more of the operator module 402, the remote system module 404 or the supervisor module 406. In some embodiments of the present disclosure, the plug and perforation module 301 is an Object Linking & Embedding protocol (OLE) Process Control (OPC) server. In some embodiments of the present disclosure, the first interface 302 correlates the data received for creating an output data file that is forwarded to the processor device 400. The output data file includes a time stamp, optionally with an offset value, that indicates when a bridge plug was deployed and when a charge was detonated, each of which may also be referred to as an operational event.

In addition to the output data file from the module 301, the processor device 400 can receive data from a manual log system 401 and/or a well identification module 403. The manual log system 401 includes a manually generated historical data of the time a bridge plug was deployed and when a perforating gun assembly was activated. This manually generated historical data is created by an individual who is observing when an electrical signal is sent from the fire control hardware to the plug and perforation apparatus within a given well. Based upon the time the electrical signal is sent form the fire control hardware, the processor device 400 can determine the depth at which the apparatus is in a given well and where the apparatus was located when an operational event occurred.

The well identification module 403 provides well identity data to the processor device 400 that indicates which specific well is receiving the plug and perforation operation. The well identity data is important because a given well pad can include multiple wells with each well receiving different well operations at a given time. The well identity data allows a remote wellsite supervisor, to be described further below, to know which specific well the plug and perforation apparatus is deployed in so that the action of the plug and perforation apparatus can be cross-referenced with the operational plan for that specific well.

In some embodiments of the present disclosure, the well identity data is provided by the well identifier source 106B, an operational plan module 405, a manual well identification data 407 input, a manual input directly into the well identification module 403, a manual input into another module of the system 100 by an operator or supervisor, or combinations thereof.

Some embodiments of the present disclosure do not require the well identity module 403, for example when there are limited numbers of wells 108 that are receiving the plug and perforation operation.

The operational plan module 405 includes details of an original operational plan with predetermined operational parameters and predetermined threshold values for the operation that is planned for a given well. The operational plan module 405 can receive, communicate to other components of the system 300 and store information regarding operational parameters including, but not limited to: the identity of the well that is supposed to receive a specific set of predetermined operational parameters, the specific stage of the well that is to receive a sub-set of specific operational parameters, the type of plug that is to be set at a given depth or stage within the well, the type of perforating gun assembly and the number of guns and charges disposed thereon, the depth or stage where one or more charges of the perforating gun assembly are to be detonated, the number of charges that are to be detonated at a given depth or stage or combinations thereof. The operational plan module 405 can also receive a predetermined threshold that is entered by the operator module and/or the supervisor. The predetermined threshold value is specific can define the efficacy and safety limits of a given operational parameter while the well operation is being performed at a given depth or stage of a given well. For example, a predetermined threshold can be set for a detected pressure in one or more conduits within the wireline system and/or the well, the volume of fluids being displaced, a depth position of the apparatus within the well, a position of the wireline system components, the number of charges that are fired at each desired location, a position in the well where a bridge plug is set, the rates at which pump-down pumps are operating, the pressure within the well generated by the pump-down pumps, the speed at which the plug and perforating apparatus is moving downhole or uphole, the tension across the length of the wireline or combinations thereof.

The processor device 400 can also be configured to manage a historical database storing historical data as part of an output module 412. The historical database can be used for review of the operations actually performed on a given well and for developing new well completion, stimulation and production operational plans.

By using such historical data, the system 100 maintains a record of the status and operation of each well on a well pad, and may use the current/real-time and historical data to calculate active time, down time and overall progress of well operations such as the average uptime or downtime, maximum uptime or downtime, minimum uptime or downtime or combinations thereof.

In some embodiments of the present disclosure, the well identity data is sent to the operator module 402 or it may be sent directly to the remote operation module 404. The operator module 402 is configured to allow an operator to enter details of the plug and perforation plan and to enter the specific specifications of the apparatus that is being used in the well operation for being forwarded to the remote operation module 404 as operator output data. For example, the operator output data can include, but is not limited to: the portion of the well where the bridge plug assembly is to be deployed, the portion of the well where the perforating gun assembly is to be fired, the top depth for same, the bottom depth for same, the desired shot density (shots per foot), the desired number of shots, the number of shots that actually occur, an estimated actual diameter of the perforations generated at the desired location by a detonated charge (inches), a nominal hole diameter caused by a detonated charge (inches), casing collar reference depth, the type of bridge plugs that are deployed on the apparatus; the number, position and types of perforating gun assemblies; the overall size of the apparatus, metallurgy of the apparatus, whether the perforating gun assembly is centralized, any depth correction values or combinations thereof.

The remote operation module 404 receives the operational information, the well identity data, the operator output data and generates organized data for display in the wellsite supervisor module 406. The organized data can include but is not limited to: wireline depth, wireline deployment speed, wireline tension, casing collar locator data, voltage of the electrical signal sent to the apparatus, amperage of the electrical signal sent to the apparatus, timestamp of the electrical signal sent to the apparatus, well pressure, well temperature, spinner logs, caliper logs, gamma ray logs, vibration data, acoustic data, well identifier data or combinations thereof. The organized data can be adjusted to various data storage formats, such as .wvxml files, .xls files, .csv, .json, .SQL files, MQTT, WITSML, POST HTTP, API, a non-cononical data format, or combinations thereof. The organized data can be saved in a database (such as module 412) and/or transmitted to a remote location for a user to access including transmission to the wellsite supervisor module 406.

The wellsite supervisor module 406 provides a visual output, based upon the measured data provided by the system and the operational plan information for a given well. With this single visual output, a wellsite supervisor can monitor well operations on one or more wells from a single location. In some embodiments of the present disclosure, only the individuals with a pre-set authority can be supervisor users and access the wellsite supervisor module 406. Because the system 100 includes the network 110, the wellsite supervisor need to not be physically located at the well site. Furthermore, a single wellsite supervisor can receive information and data from multiple wellsite supervisor modules 406 and, therefore, multiple wells at a location that is remote to the well site or remote to the wireline truck. Without being bound by any particular theory, the embodiments of the present disclosure can decrease the resources required to transport and house individuals for well operations, which can decrease the carbon footprint of such well operations.

The handshake module 408 requires that the client-computing devices 104 of at least one operator and the supervisor directly engage each other, via the handshake module 408, participate in a multi-step, multi-party process to confirm that the correct well is receiving the operation and to confirm that any change from the predetermined operational parameters—stored within the operational plan module 405—is approved by the supervisor and agreed upon by one or more operators. The process requires that each of the applicable operators and the supervisor must actively engage the handshake module 408, each using their own client-computing device 104 to send a confirmation signal. When the handshake module 408 receives all required confirmation signals, the requirements of the process are met and the handshake module 408 generates well identity data that is sent to the processor device 400. The handshake protocol can also be referred to as a DIGITAL HANDSHAKE™ or a DIGITIZED HANDSHAKE™ (both of which are trademarks of Intelligent Wellhead Systems Inc.).

The handshake module 408 can also be used if a user, either one or more operators or the supervisor, request that one or more parameters of the predetermined operational parameters be changed, such as if there is a problem encountered during the operation. Some examples of when the original operational plan typically requires a change include, but are not limited to: a downhole restriction is preventing the plug and perforation apparatus from reaching the desired location within the well; a plug has been deployed at an incorrect location within the well; the correct components of the plug and perforation apparatus cannot be procured; previous communication with an offset well can require a change in the original well plan; the predetermined perforation portion of the original operational plan is found to be incorrect; a misfire by the perforation assembly or combinations thereof.

The monitoring module 410 is configured to receive operational information from the plug and perforation module 301 and predetermined threshold values from the operational plan module 405. The monitoring module 410 is configured to compare relevant operational information with the predetermined threshold values to determine whether or not one of three types of alarms should be generated and transmitted to the applicable user interfaces. The monitoring module 410 can also be configured to store a history of any alarms that are generated, including when an alarm was generated, the type of alarm, which users received the generated alarms and what actions were taken (or not taken) subsequent to any generated alarms.

A first type of alarm is referred to as an approaching alarm. The monitoring module 410 will generate and transmit the approaching alarm to the applicable users when one or more operating parameters have achieved an approach point of an applicable predetermined threshold value. The term "approach point" is used in a relative sense herein, meaning that if a given operating parameter is one that can change very quickly, such as in a matter of minutes or seconds, during the operation then the approach point for that given operating parameter may be set at a value of between about 50% and 60% of the applicable predetermined threshold value. Whereas, if the operating parameter is one that can change more slowly, such as in a matter of hours, during the operation then the approach point for that operating parameter can may be set at a value of between about 65% and 85% of applicable predetermined threshold value.

In some embodiments of the present disclosure, the approach point is set at about 50% of the applicable predetermined threshold value, about 55% of the applicable predetermined threshold value, about 60% of the applicable predetermined threshold value, about 65% of the applicable predetermined threshold value, about 70% of the applicable predetermined threshold value, about 75% of the applicable predetermined threshold value, about 80% of the applicable predetermined threshold value, about 85% of the applicable predetermined threshold value, about 90% of the applicable predetermined threshold value, about 95% of the applicable predetermined threshold value, between about 95% and about 99.9% about 90% of the applicable predetermined threshold value or combinations thereof.

A second type of alarm is referred to as a critical alarm. The monitoring module 410 will generate and transmit the critical alarm to the applicable users when one or more operating parameters have achieved or exceeded the applicable predetermined threshold value. The threshold values are set to indicate that if the applicable operating parameter is not adjusted, that operating parameter is likely to cause damage to the well and/or any equipment involved in the operation and/or other equipment at or near the wellsite and/or that operating parameter may create a safety concern.

For example, the speed at which the plug and perforation apparatus is moving downhole is an operating parameter that may have a predetermined threshold value set at 1200 feet per hour. The approach alarm could be set at 75% of the applicable predetermined threshold value, in this example 800 feet per hour. So that if the plug and perforation module 301 receives data that the rate at which the plug and perforation apparatus is moving downhole at 700 feet per hour, then the monitoring module 410 will not generate an alarm. If the plug and perforation apparatus is moving at 800 feet per hour, then the monitoring module 410 will generate an approach alarm and transmit that alarm, via the system 100, to one or more operators and the supervisor. If the plug and perforation apparatus is moving at 1200 feet per hour, or more, then the monitoring module 410 will generate and transmit a critical alarm.

In some embodiments of the present disclosure, the approach alarm and the critical alarm both include a visual and/or an auditory alarm that is presented to each recipient user by the client-computing device 104. The critical alarm may be of greater intensity than the approach alarm e.g. a brighter, higher frequency flashing, different coloured visual alarm or a louder, higher frequency auditory alarm.

The third type of alarm is referred to as a source alarm. The monitoring module 410 will generate and transmit the source alarm to the applicable users when one or more operating parameters are not being received by the monitoring module 410 or one or more operating parameters that are being received by the monitoring module 410 are different from those expected and set out in the operational plan module 405 by a predetermined threshold amount of difference.

The fourth type of alarm is referred to as an event alarm. The event alarm includes a visual and or auditory alarm that is presented to each recipient user by the client-computing device 104. The event alarm may be set to run following a calculation on the derived data that monitors an event occurrence, or lack there of. When an event alarm is triggered it may also trigger an authority and resolution loop that allows an approved user to investigate and resolve why an event alarm was triggered. The user(s) may also determine if the record that triggered the event alarm should be entered into the well database as part of the record of the well operation, or not.

A well processor device 412 can also receive all of the organized data generated by the module 404 in a variety of formats. The well processor device 412 is configured to provide database storage for all operational information, alarm-related data and other data that is entered into the system 100 in relation to the operation that is being performed on the well or that was performed on the well.

The functional structure 300 of the system 100 can further include a communication module 414 that is configured to provide direct telecommunication between one or more users, each using a common or separate operator module 402 and the well supervisor, using the wellsite supervisor module 406. As will be appreciated by those skilled in the art, the communication module 412 can utilize any variety of telecommunication modes, including but not limited to: voice over Internet Protocol; radio; telephone; satellite phone; video conference, real-time text or video chat, or combinations thereof via the network 110 through one or more channels between the users, through direct communication links, a separate application processing interface, MQTT messenging, HTTP messenging. In some embodiments of the present disclosure, the communication module 414 provides a screen share functionality so that the supervisor and one or more operators can review specific operational information, proposed changes to the operation and the like.

The functional structure 300 of the system 100 can further include an integration module 414 that is configured to receive other data from other operations or systems that are present on the wellsite. Examples of the other data includes but is not limited to: fracturing data, such as frac pump pressure, pump rate, frac fluid concentration, frac fluid pump volumes, frac fluid mass or combinations thereof; wellhead object data, such as the diameter of an object within the wellhead, lateral location of an object within the wellhead, presence or absence of an object within the wellhead, temperature within the wellhead or combinations thereof; various pressure sensors that are being utilized on the wellsite; pump down data, such as pump down pump rate, pressure, volume or combinations thereof; wellsite valve data, such as valve position, grease weight, open time, close time or combinations thereof; water management data; proppant data; or other data that is relevant to one or more operations that are supervised by the wellsite supervisor.

Figure 6:
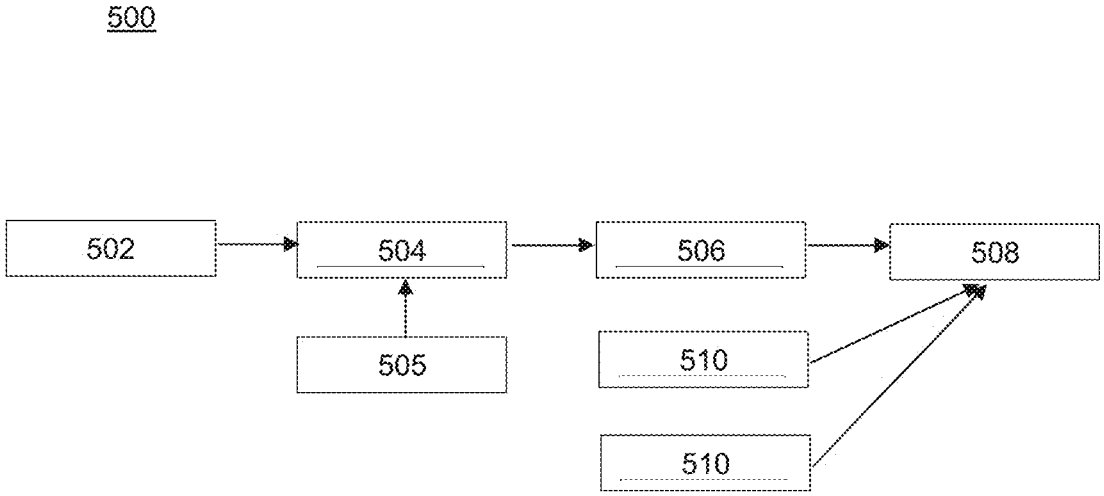
FIG. 6 is a flowchart illustrating a method, according to embodiments of the present disclosure, for monitoring an operation being performed on an oil and/or gas well.

FIG. 6 is a flowchart illustrating a computer implemented method 500 that can be implemented by the system 100 or otherwise. In some embodiments of the present disclosure, the method 500 comprises the steps of collecting 502 operational information, determining 504 operational information that relates to a location and a time at which an operational event occurred, identifying 506 the well that is receiving the operation and displaying 508 on a client-computing device the operational information, the determined data and the well identity data.

The step of collecting 502 operational information can occur by operation of the plug and perforation module 301 and/or the first interface 302. The operational information collected during the step of collecting 502 includes, but is not limited to: when the apparatus that carries the bridge plug assembly and the perforating gun assembly is activated; whether or not an electrical signal was sent to the assembly to set a bridge plug from the bridge plug assembly; whether an electrical signal was sent to the assembly to set a bridge plug or a gun was activated to detonate one or more charges; depth data, speed data and tension data regarding the length of wireline that has been deployed into the well; speed data regarding how fast the plug and perforation assembly is moving/was moved within the well; casing collar locator system data; the network address of the plug switch or gun switch; if there was an attempt to set a plug or detonate one or more charges; casing collar locator historical logs and current run logs, depth and adjusted depth (adjusted depth is the depth of wireline adjusted for cable strength and measurement drift/error corrected as compared to a logging run generated by the CCL; voltage and current data detected by the firing panel or line truck sensors; position of one or more valves, pressure, hydraulic latch, wireline location sensors, pressure, pump rate, all data from frac or any other data source on or off site. In some embodiments of the present disclosure, the step of collecting 502 also includes adding a digital time stamp to each operational information. As described herein above, the step of collecting 504 operational information includes generating actual depth values for when an operational event occurs, such as setting of a bridge plug or detonating one or more charges.

The step of determining 504 the location in the well where an operation event occurred includes comparing the collected operational information with data received from the manual log system 401 and the well identification data. Because the supervisor may be remote from the wellsite where the operation is occurring, the well identification data may be important.

The step of identifying 506 the well that is receiving the operation can be provided by the well identifier source 106B for example it may be generated by a device or it may be provided manually.

The step of displaying 508 on a client-computing device the operational information, the determined data and the well identity data can include displaying this data on a remote client-computing device so that the supervisor can receive this data without the requirement of being physically present at the wellsite where the operation is being performed. In some embodiments of the present disclosure, the step of displaying 508 can include displaying the operational information, the determined data and the well identity data from multiple wells that may or may not be located on the same wellsite.

The method 500 can further include a step of comparing 510 the operational information with the predetermined operational plan. In the event that there is a deviation of a predetermined amplitude between the operational information and the predetermined operational plan, the method may further include a step of alerting one or more of the system 100 users as part of the step of displaying 508.

In some embodiments of the present disclosure, the step of determining 504 may further include a step of configuring 505. During the configuring 505 step, the specifications of the plug and perforation assembly can be configured to improve the data that is used to determine when and where an operational event occurred.

The method 500 can further include a step of monitoring 512 the operational information and generating and transmitting 514 a first alert, a second alert or a third alert to one or more users. The first alert will be generated and transmitted if the operational information is approaching a predetermined threshold value for a given operational process. The second alert will be generated and transmitted if the operational information has met or exceeded a predetermined threshold value for given operational process. The third alert will be generated and transmitted if the operational information, or a subset thereof, is not being received or it is beyond a predetermined deviation from the operational plan. The step of generating and transmitting 514 can form part of the step of displaying 508

The method 500 can further include a step of confirming 514 by a multi-step, multi-party process to confirm that the correct well is receiving the operation or to confirm that any change from the predetermined operational parameters can proceed. The step of initiating 514 can be started by any user but ultimately must be approved by the wellsite supervisor's participation in the multi-step, multi-party process. The applicable user's progress through the step of confirming 514 can also form part of the step of displaying 508 so that all participants can view the progress towards confirmation, or not.

The method 500 can further include a step of communicating between the wellsite supervisor and one or more users.

Figure 7:
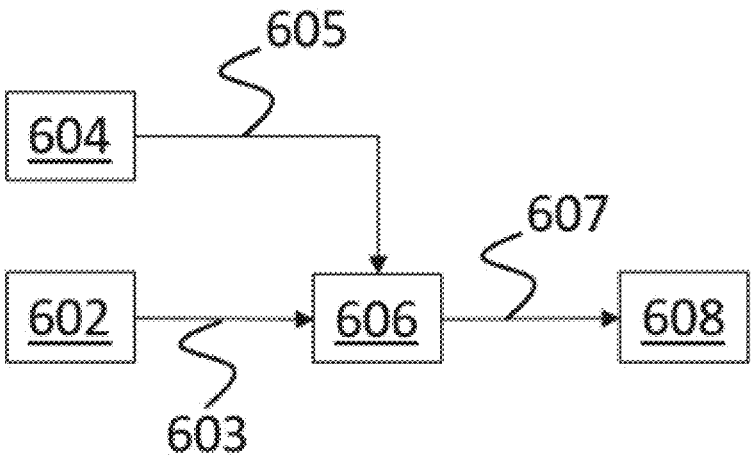
FIG. 7 is a schematic representation of a method and/or functional structure for creating an alert, according to embodiments of the present disclosure.

FIG. 7 is a schematic representation of a method and/or functional structure for creating an alert, according to embodiments of the present disclosure. The method comprises a step of introducing (or setting) within an operational plan 604 one or more predetermined threshold values for an operational information point. The method further includes a step of sharing 605 the predetermined threshold values with a data processor 606. The method further includes sharing data 603 generated by one or more sensors 602 with the data processor. In some embodiments of the present disclosure, the sensor data is shared as an MQTT format message (or other format of message) to the data processor. The sensor data provides details of operational events or other operational parameters to the data processor. The data processor then converts the information from the operational plan and/or the sensor data so that it is in a common format. The data processor will also compare the sensor data with the predetermined threshold values for each given operational information stream. For example, tension of the wireline may have a predetermined threshold value that is compared with wireline tension data generated by a tension sensor. As will be appreciated by those skilled in the art, the various sensors described herein above can contribute towards providing sensor data to the data processor.

In the event that any sensor data approaches, meets or exceeds a predetermined threshold value for an applicable operational information set, then the data processor will generate 607 an alert that is sent to one or more user interfaces 608.

Figure 8:
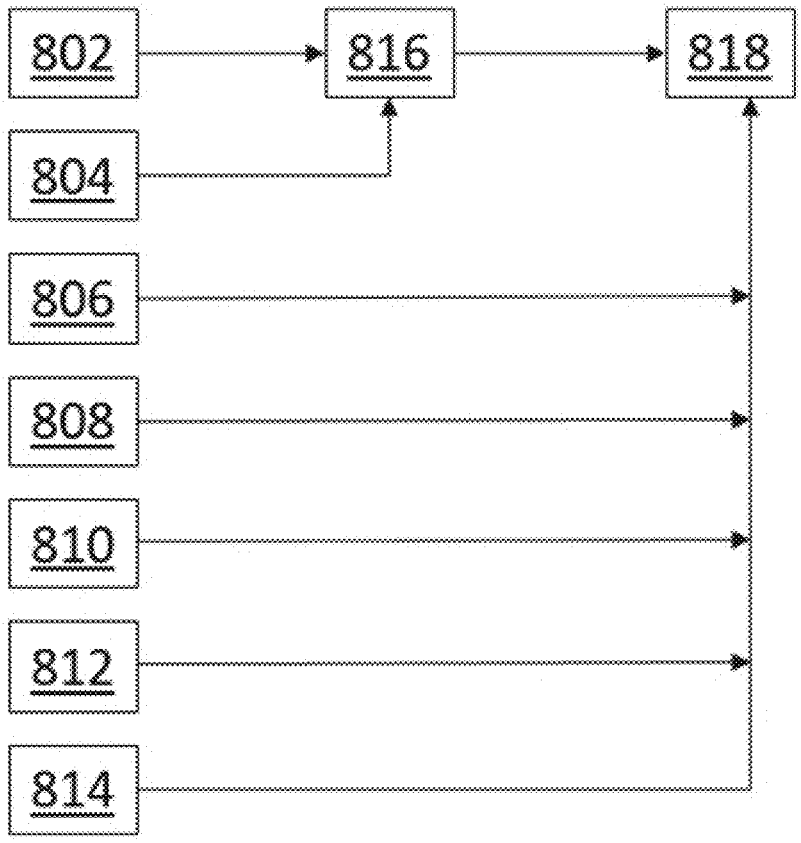
FIG. 8 is a schematic representation of a method and/or functional structure for translating and collecting data for storage in a database, according to embodiments of the present disclosure.

FIG. 8 is a schematic that represents a method and/or functional structure for translating and collecting data for storage in a database 818. The functional structure can aggregate/collect data from a wireline system data feed 802, for example but not limited to an ASCII Serial Feed, that sends wireline system data to a third party interface (TPI) 816. The wireline system data can be sent by an RS 232 standard format or other similar telecommunication protocol. The TPI 816 can also receive data from a firing panel system board 804 that creates data for each event that occurs via the firing panel (e.g. deploy a plug, detonate a charge). The TPI formats the data it receives into a common format, for example MQTT or other similar formats, for sending to the database 818. The TPI is capable of interfacing with various apparatus using a variety of communication protocols, such as: Ethernet, WiFi, RS232, RS485, USB, TCP/IP, UDP, MQTT, WITSML, HTTP, Modbus RTU, Modbus TCP/IP, Profinet, profibus, can bus, HART, UPB, API, FTP or combinations thereof. The TPI runs software that can receive data in any of these formats and then the TPI can reformat (or translate) the received data into a TPI output data format with an optional timestamp.

The TPI can also perform various calculations and analytic steps on data that it receives or data that is received by a different TPI on the same network. For example, the wireline modules provides wireline depth data from the wireline system sensors and that depth data is sent/transmitted as a series of MQTT messages on the network of the system. The depth data is then recorded and saved on a local database and the depth data is also delivered to a cloud-based database to allow for real-time delivery of depth data (and all other operational information). The delivery of operational information to the cloud can, for example, be via high frequency, low latency streaming.

The real time delivery of operational information to the cloud allows users that are remote from the well that is receiving the operation and to access the display module (described further below).

The autoshot program/module of the present disclosure is also configured to detect when a plug is deployed or a charge is detonated using a .csv file watcher operation that detects when a firing window log file has been created. The autoshot program/module is also configured to employ other methods for detecting a plug set or shot fired event that includes software that accesses a database containing firing window logs or records of plug set and shot fired, additionally, the autoshot program/module includes a software module that can receive a data stream via several communication methods in real-time to monitor for the plug set and shot fired data before the information is saved to disk. The time that the filing window log file is created is included in a timestamp with the voltage and current of the electrical signal that caused the operational event and resulted in the firing window log file to be created. The autoshot program/module is configured to cross-reference the timestamp with the wireline depth data at the applicable time, as saved in the database (local or on the cloud) and a plug deployed or shot detected signal message is sent back to the database to indicate the time, depth and attempt number of a given plug deployment or charge detonation and which plug and charge (or gun) on the perforation apparatus was activated. Once the plug deployed or shot detected signal enters the database, the autoshot program/module assigns the signal to a given well identity (based on the applicable well identification data) and a stage/interval number (as derived from the well identification data) and the applicable meta data for the plug and charge are assigned to a given operational event. Ultimately this data collection/aggregation, formatting and analysis results in various displays that display operational information, operational events in various formats for transmission via various protocols.

The database can also receive various data that can be input manually, such as an operational plan data 806, plug library data 808, gun library data 810 or combinations thereof. The database can also receive data regarding the identity of the well 812 that is receiving the operation that is being monitored and data of any operational events that are occurring therein and data about which stage of the well 814 is receiving an operational event. The database 818 can store the received data for retrieval by other components of the system.

Figure 9:
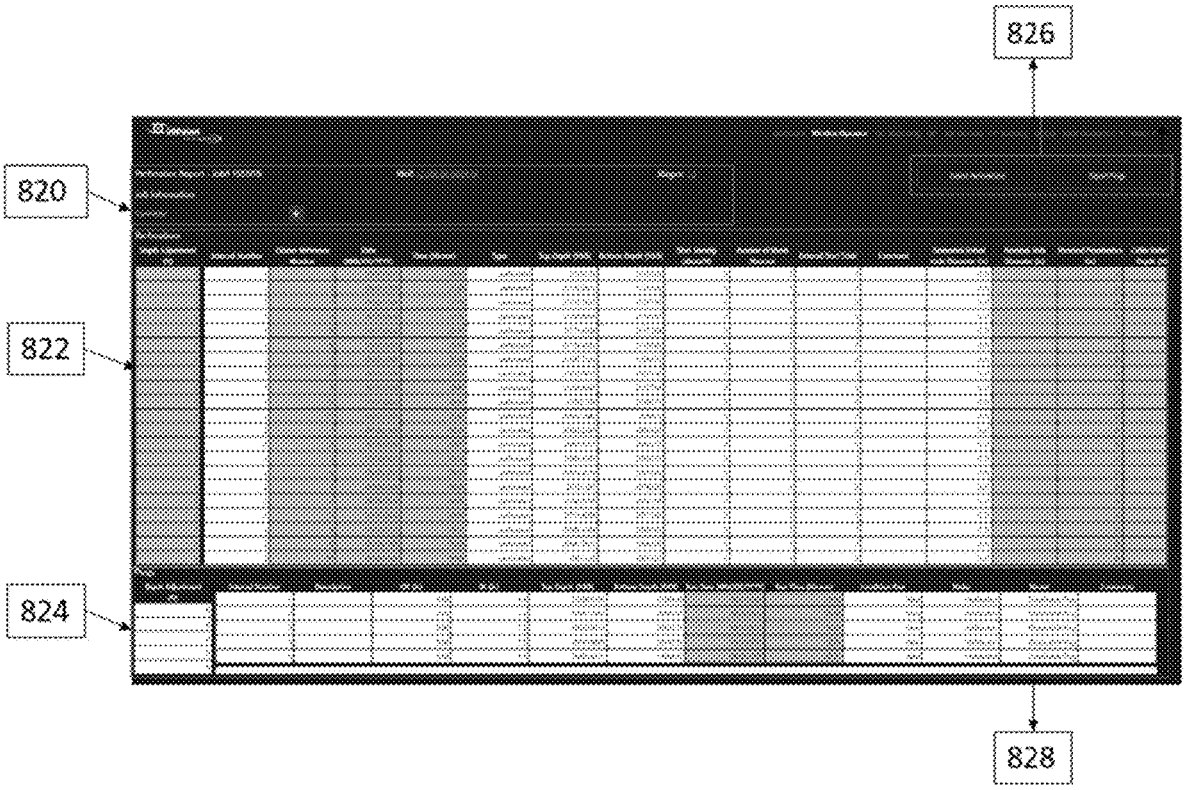
FIG. 9 is a schematic representation of a method and/or functional structure for creating a view report, according to embodiments of the present disclosure.

FIG. 9 is a schematic representation of a display module that can be displayed on one or more user interfaces, according to embodiments of the present disclosure. The display module can provides a user with real-time operational information, alerts, well identification data and the like. The display module receives data from a job module 820, a perforation module 822 and a plug module 824. The job module 820 provides information about a given operation, such as the well identification data, stage count and other information pertinent to the operation being conducted (e.g. the names of service companies performing one or more operations on a given well, clearance of other users to receive (or not) specific operational information). The perforation module 822 contains the perforation report that includes: the stage/interval number, charge cluster reference number, date, time, top depth (ftKB) or combinations thereof as they relate to perforation (i.e. detonate charges) operational events. The perforation module 822 also includes meta data that relates any operational events described by the perforation module to relate back to how the tool string was configured in the tool string configuring module. The plug module 824 contains the plug report that includes: the stage/interval number, top depth (ftKB), run date, run time or combinations thereof. The plug module can also include meta data with the plug report information to relate back to how the tool string was configured.

The display module can send data to an export module 826 that includes export perforation and export plug buttons that enable a user to export the perforation and plug reports using a delivery and formatting mechanism of their choosing (e.g. .wvxml, .csv or other application program interfaces for export to a well database). The display module avoids the requirement of manually entering operational information from the various sources of operational information, operational event detection systems and other data analytic/aggregating processes.

Figure 10:
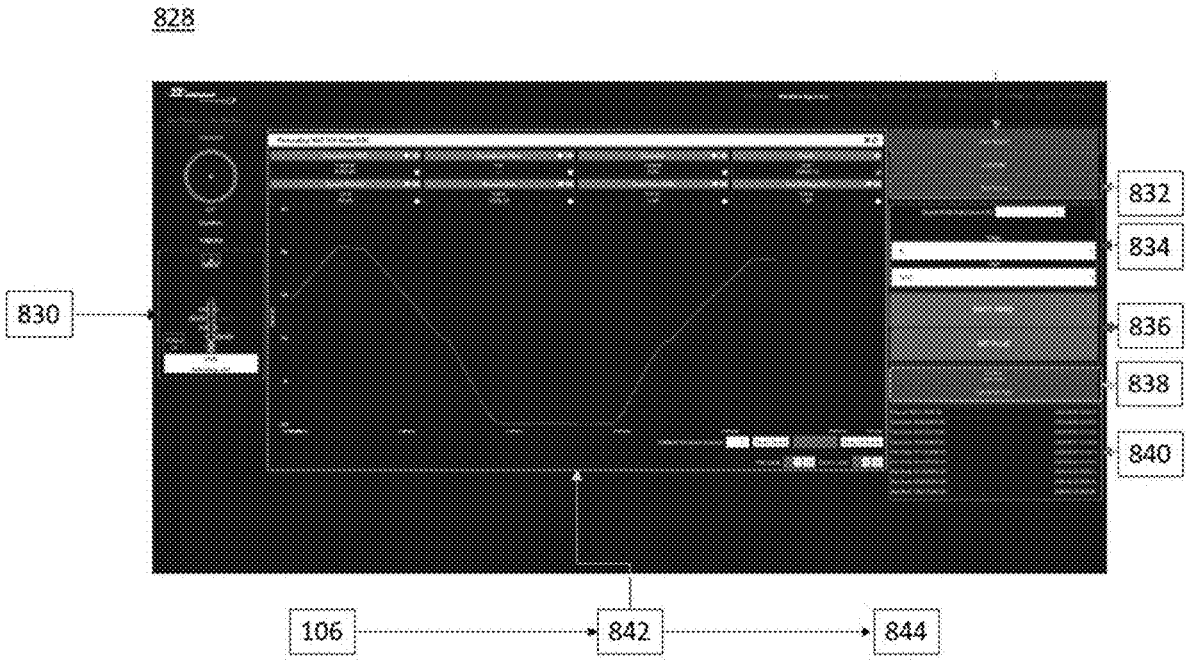
FIG. 10 is a schematic representation of a method and/or functional structure for data that is generated in the view report of FIG. 9, according to embodiments of the present disclosure.

The display module can also include a view report button that generates a new report in a view report module 828 that allows the user to view, verify and export the plug and perforation reports in other formats of their choosing. As shown in FIG. 10, the view report module 825 can include: a real-time operational information display 840, well identification data 830 that is generated as described herein above and wireline system sensory data 106 as provided by the TPI. The view report module also includes data from a tool string configuration module 832 which enables the user to configure the number of charges, the charge type, the charge location on the tool string, the plug type, the number of plugs, the location of the plug on the tool string and the toolstring offset measurements (the distance from the CCL at the top of each gun) to provide the top depth measurement.

The view report module 828 also includes data from a depth shift adjustment module 834, which can be generated automatically by the system to compensate for any stretch of the wireline and any depth sensor errors. The system can automatically generate the depth shift adjustment based on CCL data to generate a corrected depth.

In the event that a wireline operator is not using a firing panel that is compatible with the system, a shot fired or plug deployed button can be used to indicate when an operational event occurs that relates to a plug or charge 836.

The view report module 828 also includes data of a misfire 838, such as when an attempt was made to detonate a charge but it misfired.

Figure 11:
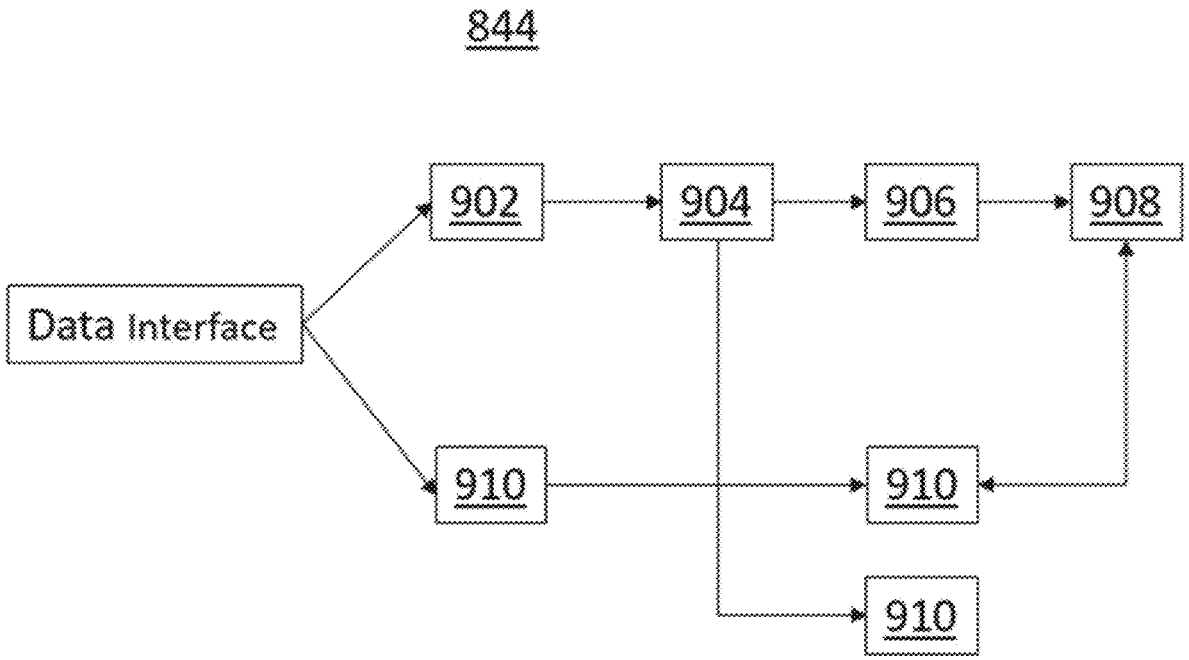
FIG. 11 is a schematic representation of a display module that receives and displays data from a data interface for users of the system, as shown in FIG. 10, according to embodiments of the present disclosure.

FIG. 11 is a schematic of another embodiment of the system that depicts how data from the TPI (shown as data interface) is distributed through the various modules of the system 844. For example, the data interface can distribute data through an IoT hub 902, to an event hub 904 (which can also send event data to a storage module 908), through a signal R hub 906 to allow real-time streaming on the user interface 908. The data interface can also distribute data through a database synching tool 910 that communicates data with an SQL module. The user interface 908 may also communicate data with the SQL module 910.

Figure 12:
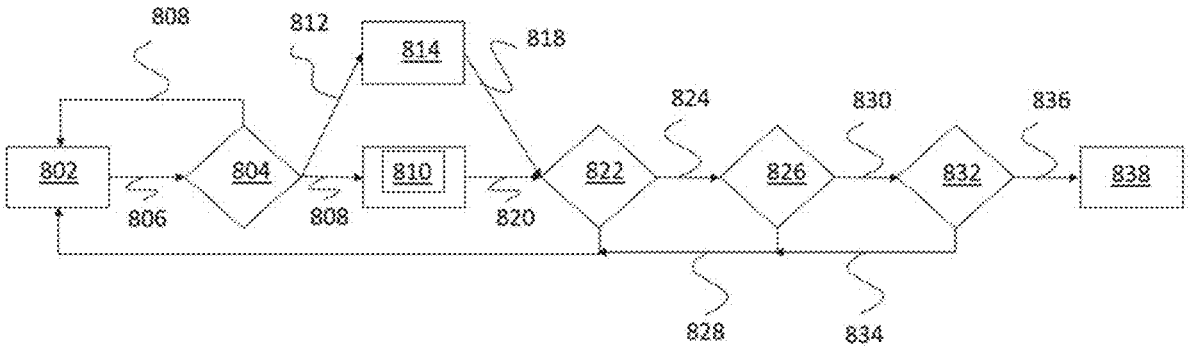
FIG. 12 is a schematic representation of an authority loop for use during a well operation.

FIG. 12 shows a schematic of an authority loop that can be used with embodiments of the present disclosure. The authority loop begins when a user initiates 702 a request for authority to proceed with a specific service or operational step. This requires that the user inputs a personal identification number (PIN). The initial request is forwarded 706 to a data processor of the system to determine 704 if it is safe for the requested service or step to occur. This determination by the system can be based upon an assessment of whether or not there are any objects positioned within the wellhead, the pressure within one or more conduits, the position of a valve or combinations thereof. If it is determined 704 that it is not safe to proceed with the requested service or step, then an unsafe signal 708 is sent back to the user. If it is determined 704 that it is safe to proceed, a safe signal 708 is sent to initiate a dialogue box on all applicable and local user interfaces. In the embodiments of the present disclosure where there are remote users, then a safe signal 712 may be send remotely to initiate a similar dialogue box 714. All users who have a user interface that has an initiated dialogue box may send a reply 720 (718 for remote users) back to the system, including their PIN, where it is determined 722 if all users have agreed that the requested service or step may occur. The system will wait until all applicable users have replied. Once all users have replied, a survey signal 724 that includes the results of applicable users responses is generated for further processing 726. If all users reply yes, in consensus, then a consensus message 730 is generated and shared back to the system and users. If the users do not reach a consensus to proceed, then a rejection signal 728 is generated and forwarded back to the first user. The consensus message 730 will initiate a further safety check 732 to confirm it is safe to proceed with the requested service or step. If it is not safe, then a not safe signal 734 is generated and sent to the first user. If it is determined to be safe to proceed with the requested service or step, then a further safe signal 736 is generated and sent out to all users and recorded in a database 738 of the system. In some embodiments of the present disclosure, the system can perform step 704/732 multiple times to assess again if it is safe to proceed with the requested service or step.

Some examples of when the system may generate an unsafe signal include, but are not limited to: a user requests that a wellhead pressure control valve be closed but the system determines that there is wireline or another tool present in the wellhead; a user requests to open a valve that controls fluid communication with a conduit and the system determines that there is a high pressure differential between two sides of a closed valve within the conduit preventing damage to the wireline tool string, wireline cable and pressure control equipment.

What is claimed is:

1. A computerized method for remote monitoring of a well operation, the method comprising steps of:

a. collecting operational information of the well operation, including a predetermined operational plan;

b. establishing one or more operating thresholds based upon the predetermined operational plan;

c. creating an actual depth value for determining a location within each well when an operation event is performed by a downhole apparatus, wherein creating the actual depth value comprises a step of correlating operational information of a fire control system and a wireline data acquisition system, and wherein the wireline data acquisition system operational information comprises a depth value and a time stamp associated therewith;

d. displaying automatically on a client-computing device the collected operational information and the actual depth value and any associated plug library data and gun library data, in real time; and e. assessing whether the collected operational information and the actual depth value are approaching and/or exceeding the one or more operating thresholds, wherein if the collected operational information and the actual depth value are approaching and/or exceeding the one or more operating thresholds, adjusting one or more steps of the well operation to increase compliance with the predetermined operational plan.

2. The method of claim 1, wherein the step of displaying is on a client-computing device that is remote from a wellsite where the operational information is collected.

3. The method of claim 1, wherein the collected operational information is derived from a fire control system and a wireline system.

4. The method of claim 1, further comprising a step of identifying a well that is receiving the well operation.

5. The method of claim 1, wherein the fire control system operational information includes a time stamp for an operational event.

6. The method of claim 5, wherein the synched event time is cross-referenced with a location operational information point from the wireline system.

7. The method of claim 6, further comprising a step of cross-referencing the depth value with the predetermined operational plan to identify a plug or charge that was planned to be deployed at the depth value.

8. The method of claim 7, further comprising a step of using a toolstring offset value, based upon the predetermined operational plan and calculating the actual depth value of where the identified plug was set or the identified gun was fired based upon the toolstring offset value and the depth value.

9. The method of claim 1, wherein the step of correlating includes a step of creating a synched event time between a fire control system and a wireline data acquisition system.

* * * * *